US006454643B1

(12) United States Patent
Bode

(10) Patent No.: US 6,454,643 B1
(45) Date of Patent: Sep. 24, 2002

(54) SANDER WITH A SANDING PAD

(75) Inventor: Olaf Bode, Utting (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/952,160

(22) Filed: Sep. 14, 2001

(30) Foreign Application Priority Data

Sep. 18, 2000 (DE) ..... 100 46 063

(51) Int. Cl.[7] ..... B24D 17/00

(52) U.S. Cl. ..... 451/520; 451/523

(58) Field of Search ..... 451/514, 515, 451/520, 523, 524

(56) References Cited

U.S. PATENT DOCUMENTS 4,475,317 A * 10/1984 Dicke ..... 451/357
5,759,094 A * 6/1998 Bosten et al. ..... 451/356

* cited by examiner

*Primary Examiner*—M. Rachuba
(74) *Attorney, Agent, or Firm*—Sidley Austin Brown & Wood, LLP

(57) ABSTRACT

A sander including a motor-driven rectangular base plate (1), and a locking mechanism (2) for releasably attaching a sanding pad (3) to the base plate (1) and including at least one pawl (6, 7) provided on each of the font side (21) of the base plate (1) and the sanding pad (3) and having a contact surface (20) having a longitudinal extent a length of which corresponds to from 0.2 to 1.3 times of a width (b) of the front side (21) of the base plate, with contact surfaces (20) being movable relative to each other in opposite direction for effecting attachment and detachment of the sanding pad (3) to and from the base plate (1).

6 Claims, 2 Drawing Sheets

Fig. 1
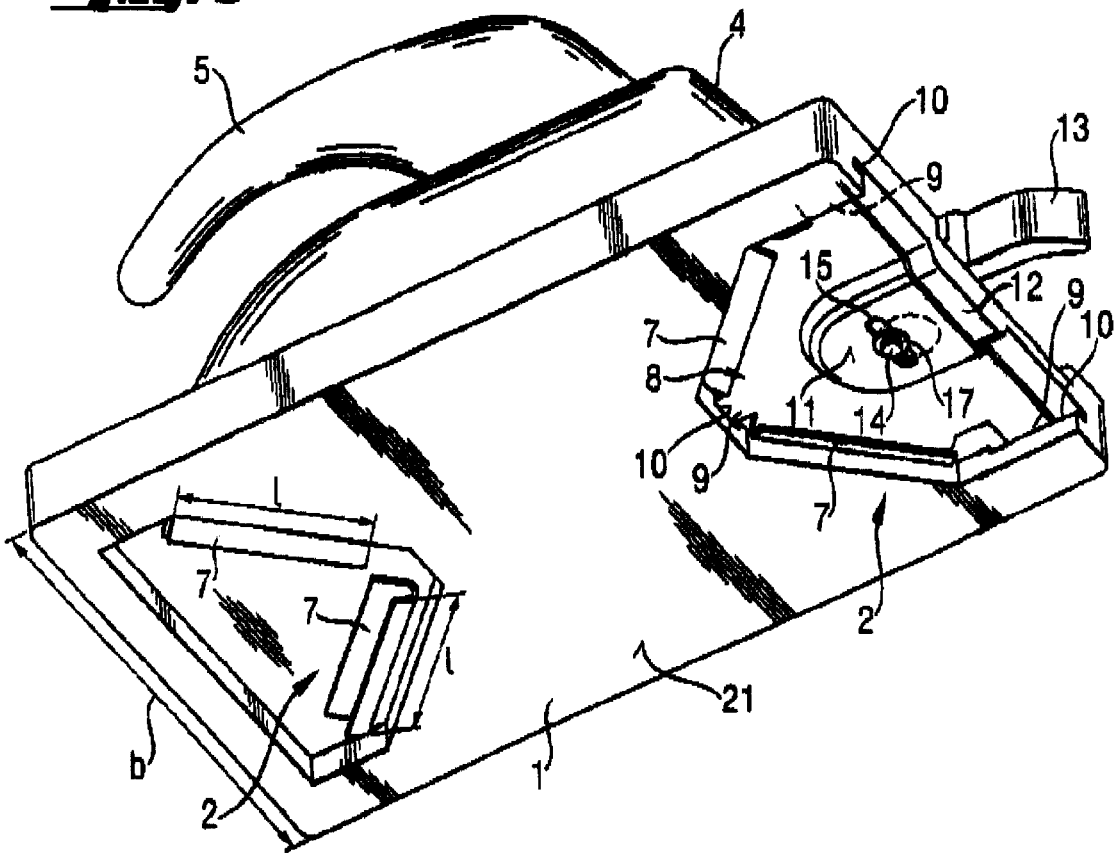
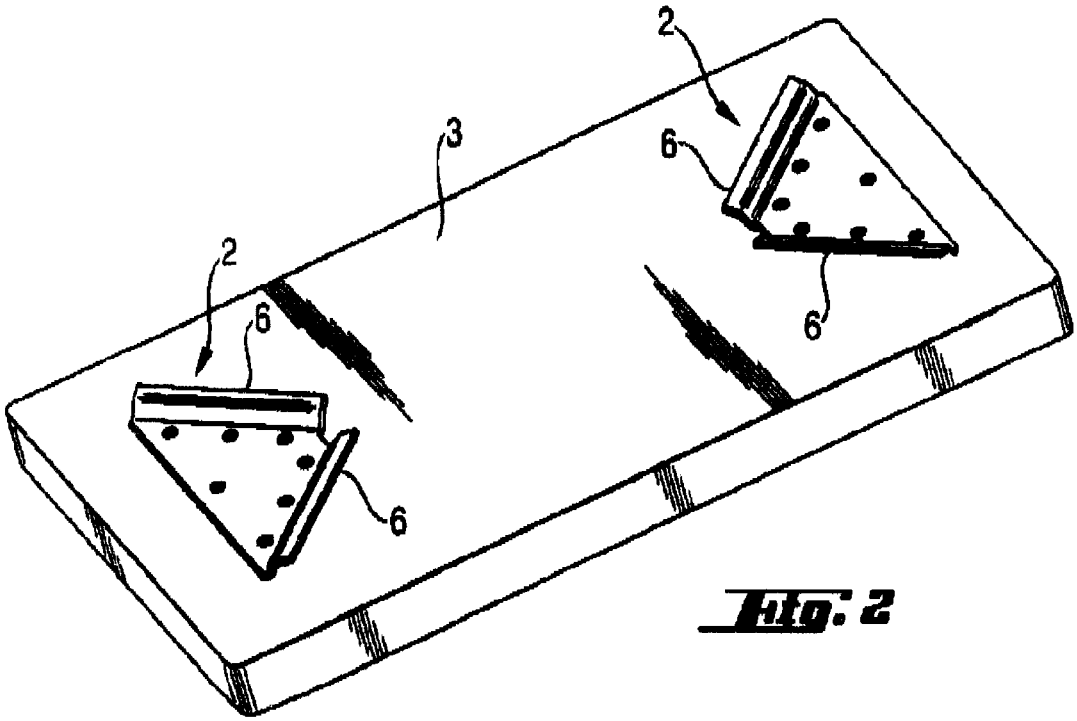
Fig. 2

SANDER WITH A SANDING PAD

BACKGROUND OF THE INVENTION

1. Field of the Invention

The present invention relates to a sander and, in particular, to a manually operated sander, including a rectangular babe plate, a sanding pad attachable to a front side of the base plate, and a locking mechanism for releasably attaching the sanding pad to the base plate and including at least one pawl provided on each of the front side of the base plate and the sanding pad and having a contact surface, with attachment and detachment of the sanding pad to and from the base plate being effected by respective relative movements of the contact surfaces of the respective pawls in opposite directions.

2. Description of the Prior Art

With the sanders of the type described above, for treating workpieces, an abrasive or emory paper is used. The abrasive paper can be releasably secured to the sanding pad, e.g., with a mechanical locking device or with VELCRO® fastening means. When the VELCRO® fastening means is used, the sanding pad should he provided with a surface specifically adapted for attaching a VELCRO® element thereto. When the VELCRO® fastener is not used for attaching the abrasive paper to the sanding pad, no specific treatment of the respective surface of the sanding pad is necessary. In addition, the side of the sanding pad adjacent to a workpiece may be formed by an elastic material, e.g., a foam material. Such a sanding pad is subjected to wear and with time needs to be replaced.

Conventionally, the sanding pad is secured to the front side of the base plate with screws, which permits to release the sanding pad when necessary. To prevent loosening of the screws, as a result of vibrations, during sanding of a workpiece, the screws must be tightened very strongly.

German Utility Model DE-U-200 03 064 disclosed a sander in which the sanding pad is secured to the base plate by a locking mechanism, The locking mechanism including at least one pawl provided on each of the front side of the base plate and the sanding pad and having a contact surface. The attachment and detachment of the sanding pad to and from the base plate are effected by respective movements of the contact surfaces of the respective pawls in opposite directions against a biasing force, The advantage of the connection of the sanding pad with the base plate according to DE-U-200 03 064 consists in that it can be effected relatively simply with a locking mechanism released by a user of the sander without using any tool. Such a connection prevents the user from attaching to the base plate of an unsuitable or mismatched sanding pad, without a suitable tool being available.

However, a drawback of the known connection consists in that occurring high centrifugal forces cannot be adequately absorbed by the connection or attachment means. This results in a high load acting on the locking mechanism, which significantly reduces its service life.

Further, the locking mechanism with spring biasing means complicates its handling by a user. Specifically, the force, which the user has to apply to overcome the biasing force of the spring means which has to be matched to the possible high centrifugal forces, is rather high. This makes the pad replacement more difficult.

Accordingly, an object of the present invention is to provide a sander with a locking mechanism for releasably attaching a sanding pad, which can be easily handled.

Another object of the present invention is to provide a sander with a locking mechanism capable to withstand high centrifugal forces.

A further object of the present invention is to provide a sander with a locking mechanism that would provide for a cost-effective manufacturing of the entire sander.

SUMMARY OF THE INVENTION

These and other objects of the present invention, which will become apparent hereinafter, are achieved by providing a sander with a locking mechanism of the above-describe type in which the contact surfaces of the pawls have a longitudinal extent a length of which corresponds to from 0.2 to 1.3 times of a width of the front side of the base plate.

A big length and, thereby, a large contact surface of the pawls insure that a large centrifugal force, which is produced between the sanding pad and the base plate, is absorbed without any problem, as the greater part of the centrifugal force is distributed between the surfaces of both the base plate and the sanding pad. The distribution of the centrifugal force between the base plate and the sanding pad permits to form lighter base plate and sanding pad, as a point application of forces does not exist. Large surface area of the contact surfaces facilitate their adjustment and significantly facilitates handling of the locking mechanism. The contact surfaces of the pawls can be formed as circular or elongate surfaces.

According to a preferred embodiment of the present invention, to insure a most even distribution of the centrifugal forces between the sanding pad and the base plate, the contact surfaces extend longitudinally from the periphery of the front side to its center. This ray-liked arrangement of the pawls or their contact surfaces can be easily produced and, therefore, this arrangement of the contact surfaces is very cost-effective. In particular, with orbital sanders, the discussed above arrangement of the contact surfaces insures an optimal releasably attachment of the sanding pad to the base plate.

Advantageously, there are provided four contact surfaces on each of the base plate and the sanding pad, with adjacent contact surfaces forming an angle of about 90° with each other. This provides for absorbing centrifugal forces in all directions. This is particular important with orbital sanders because the load in these sanders is not applied from a single direction. Further, with four contest surfaces arranged in the above-discussed manner, an automatic centering takes place during the attachment of the sanding pad to the base plate. The automatic centering significantly facilitates handling of the inventive sander in comparison with conventional sanders. Moreover, the centrifugal forces acting on the sanding pad produce a wedge effect with respect to the correspondingly pawls as the adjacent pawls and the contact surfaces form a V-shaped arrangement. At the same time, the about 90° -arrangement of the pawls permits to release the sanding pad from the base plate without application of substantial forces.

To provide for a simple and rapid replacement of the sanding pad, the locking mechanism includes an adjusting ever for displacing at least one pawl and its contact surface between engaging and release positions of the locking mechanism. The adjusting lever can be actuated with one hand. It can be arbitrary formed. E.g., the adjusting lever can be formed as a knob or as a wing-shaped engagement element. Advantageously, the adjusting lever is supported on the base plate. However, the adjusting lever can be supported at another location, e.g., on a housing to which the base plate is secured. The respective pawl advantageously can be provided with an elongate opening in which a bolt provided on the adjusting lever, engages. This insures a cost-effective manufacturing of the locking mechanism according to the present invention. Further, die inventive locking mechanism provides for an increased service life in a very dusty environment.

Advantageously, there are provided two adjustable contact surfaces on the same pawl in order to insure a reliable attachment of the sanding pad to the base plate. With four contact surfaces, simple replacement of the sanding pad is insured because in the release position, only two of the four contact surfaces are in an engagement position.

The adjustable contact surfaces are advantageously provided on a pawl formed of metal which insures, on one hand, a sufficiently high stability and, on the other hand, a high elasticity. Moreover, a small friction resistance of metal facilitates displacement of the contact surfaces into the release position, which further facilitates handling of the sander.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 1 a perspective view of a sander according to the present invention without a sanding pad;

FIG. 2 a perspective of a sanding pad of a sander according to the present invention;

DETAILED DESCRIPTION OF THE PREFERRED EMBODIMENT

Figure 3:
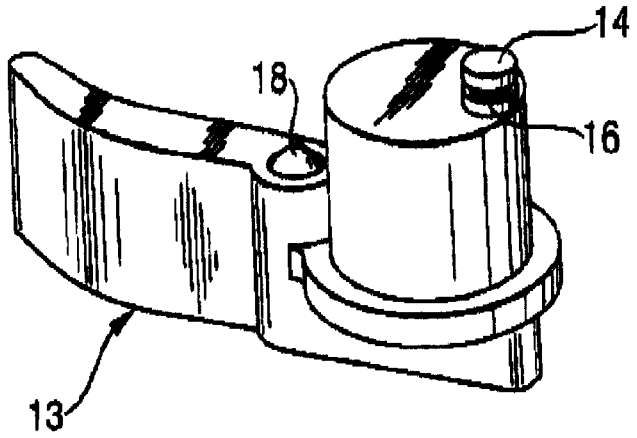
FIG. 3 a perspective view of an adjustment lever of a sander according to the present invention.
Figure 4:
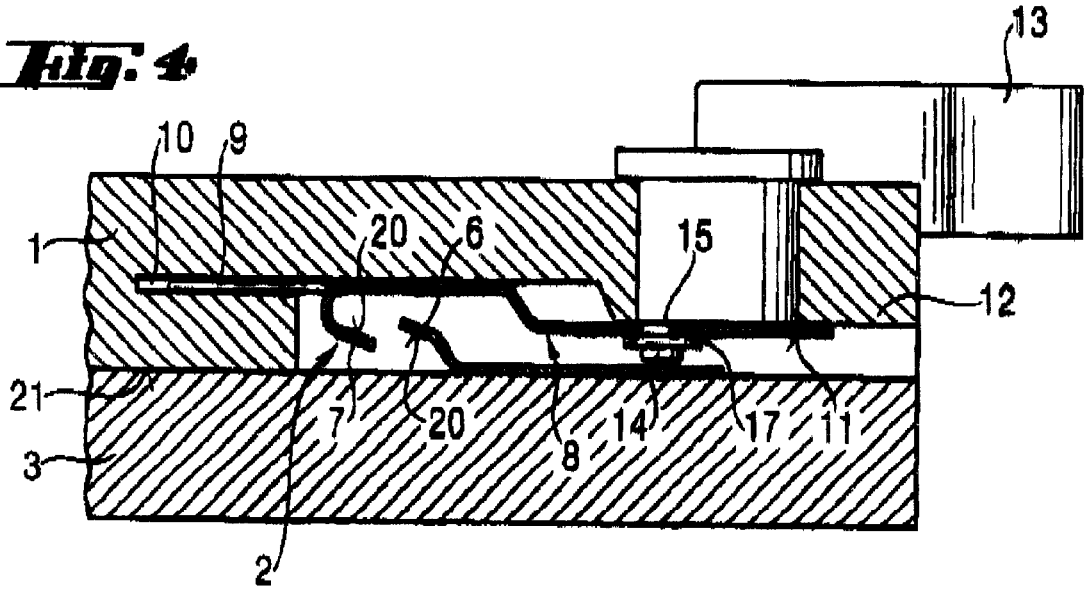
FIG. 4 a partial cross-sectional view of a sander according to the present invention with pawls in a release position.

A sander, in particular a manually operated sander according to the present invention, which is shown in FIGS. 1–4, includes a motor-driven rectangular base plate 1, and a sanding pad 3 securable on the front side 21 of the base plate 1 with a locking mechanism 2.

The base plate 1 is displaceably secured to a housing 4 which is provided with a handle 5 for guiding the sander. The locking mechanism 2 has four pawls 6 and 7 provided, respectively, on a side of the sanding pad 3 adjacent to the base plate 1 and on a front side 21 of the base plate 1 which faces the sanding pad 3. The respective pawls 6 and 7 of the sanding pad 3 and the base plate 1 engage each other upon a relative displacement of the sanding pad 3 and the base plate 1 with respect to each other. The corresponding pawls 6 and 7 engage each other in a region of their contact surfaces 20, as it is clearly show in FIG. 4

There are provided, on the front side 21 of the base plate 1 facing the sanding pad 3, as discussed above, four pawls 7 which are hook-shaped and are formed, e.g., of sheet metal, The pawls 6 are fixedly secured to the sanding pad 3. The adjacent pawls 6, in particular, their contact surfaces 20 form an angle of about 90° and extend from an edge region of the sanding pad 3 to its center. The pawl 6 on the sanding pad 3 project beyond a side of the sanding pad 3 adjacent to the front side 21 of the base plate 1.

Two of the pawls 7 are fixedly secured on one half of the front side 21 of the base plate 1. Two other pawls 7 are provided on a triangular locking plate 8 which is supported on the base plate 1 for a longitudinal displacement along the base plate 1. The base plate 1 has, in the region of the pawls 7 and the locking plate 8 respective recesses in which the pawls 7 and the locking plate 8 are received.

In this way, the pawls 7 and the locking plate 8 do not project beyond the front side 21 of the base plate 1.

For its guiding, the locking plate 8 has several rails 9 engaging in respective grooves 10 formed in the base plate 1. The grooves 10 are provided in the walls of the recess in which the locking plate 8 is received. The grooves 10 provide for displacement of the locking plate 8 in a plane extending parallel to the front side 21 of the base plate 1. In addition, the locking plate 8 is provided with an elongate depression 11 that cooperates with a guide web 12 provided on the bottom of the locking plate-receiving recess.

An adjusting lever 13, which is shown in detail in FIG. 3, is provided with a bolt 14 that engages in an elongate opening 15 formed in the locking plate 8. The adjusting lever 13 is received in a cylindrical recess (not shown), which is formed in the base plate t, for pivotal movement therein. To prevent displacement of the adjusting lever 13 out of the opening 15 and the receiving recess, which is formed in the base plate 1, the bolt 14 is provided, at its end remote from the lever 13, with a circumference groove 16 in which a lock washer 17 engages. In order to obtain an optimal adjusting characteristic of the adjusting lever 13, the lever 13 is provided, approximately in its center, with a rolling ball 18 supported against the base plate 1 and which becomes locked in the engaging position of the sanding pad (3).

Upon a pivotal movement of the adjusting lever 13, the bolt 14 moves, duc to its eccentric arrangement on the lever 13, circularly in a plane parallel to the front side 21 of the base plate 1. The displacement in the longitudinal direction of the base plate 1 is used for adjusting the locking plate 8. The remaining movement components in a direction transverse to the longitudinal direction are compensated by the elongate opening 15. This permits to use larger tolerances during manufacturing of the locking mechanism 2.

When the adjusting lever 13 caused displacement of the locking plate 8 away from the center of the base plate surface, the sanding pad 3 is pressed against the base plate 1 with pawls 6 and 7. The arrangement of the pawls 6 and 7 and, in particular, of the contact surfaces 20, prevents an excessive loading of the base plate I and of the sanding pad 3 when the sander is operated by a centrifugal Force. The large surface area of the contact surfaces 20 provides, among other, for an easy adjustment of the locking plate 8 and contributes significantly to the ease of handling of the locking mechanism 2. These advantages are increased even more when the pawls 6, 7 and the locking plate 8 are formed of sheet metal. In addition, the sheet metal insures that the sanding pad 3 is pressed sufficiently tight even after multiple attachments and detachments.

Figure 5:
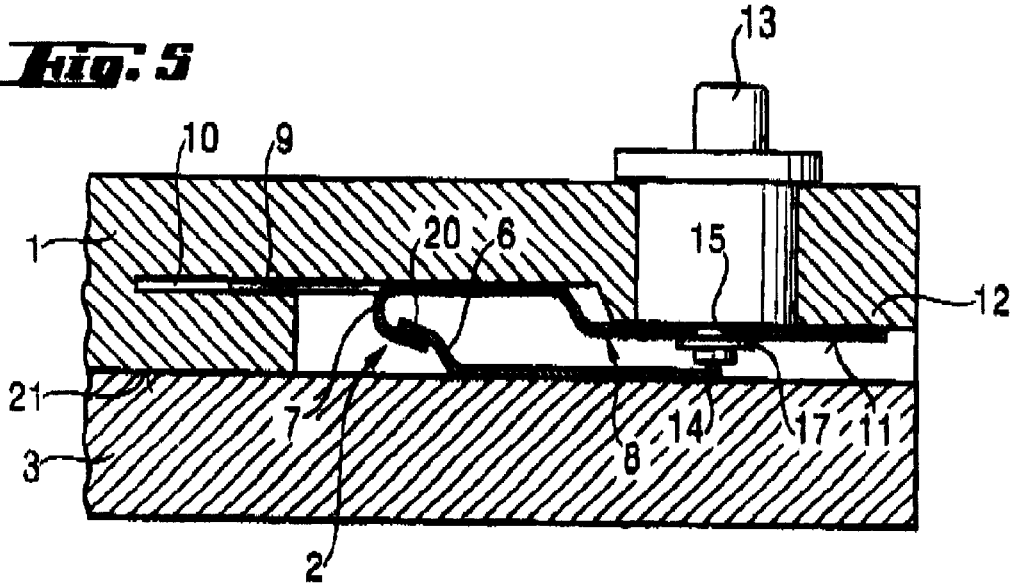
FIG. 5 a partial cross-sectional view of a sander according to the present invention with pawls in an engaging position.

For releasing of the sanding pad 3, as particularly shown in FIG. 5, the locking plate 8, together with the pawls 7, moves toward the center of the front side 21, causing disengagement of the contact surfaces 20 of the pawls 6 and 7. In this position of the locking plate 8, the sanding pad 3 can be removed.

The length 1 of the contact surfaces 20 corresponds approximately to the width b of the front side 21 of the base plate 1.

Though the present invention was shown and described with references to the preferred embodiment, such is merely illustrative of the present invention and are not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A sander, comprising a substantially rectangular base plate (1); a sanding pad (3) attachable to a front side (21) of the base plate (1); and a locking mechanism (2) for releasably attaching the sanding pad (3) to the base plate (1) and including at least one pawl (6, 7) provided on each of the front side (21) of the base plate (1) and on an adjacent side of the sanding pad (3) and having a contact surface (20) having a longitudinal extent a length (1) of which corresponds to from 0.2 to 1.3 times of a width of the front side (21) of the base plate, whereby attachment and detachment of the sanding pad (3) to and from the base plate (1) are effected by respective relative movements of the contact surfaces (20) of the respective pawls (6, 7) in opposite directions, wherein the pawls (6, 7) extend longitudinally from a periphery of the front side (21) to a center of the front side (21) of the base plate (1).

2. A sander, comprising a substantially rectangular base plate (1); a sanding pad (3) attachable to a front side (21) of the base plate (1); and a locking mechanism (2) for releasably attaching the sanding pad (3) to the base plate (1) and including at least one pawl (6, 7) provided on each of the front side (21) of the base plate (1) and on an adjacent side of the sanding pad (3) and having a contact surface (20) having a longitudinal extent a length (1) of which corresponds to from 0.2 to 1.3 times of a width of the front side (21) of the base plate, whereby attachment and detachment of the sanding pad (3) to and from the base plate (1) are effected by respective relative movements of the contact surfaces (20) of the respective pawls (6, 7) in opposite directions, wherein the locking mechanism (2) has four pawls (6, 7) provided on each of the front side (21) of the base plate (1) and the sanding pad (3), with adjacent two pawls forming with each other an angle of about 90°.

3. A sander, comprising a substantially rectangular base plate (1); a sanding pad (3) attachable to a front side (21) of the base plate (1); and a locking mechanism (2) for releasably attaching the sanding pad (3) to the base plate (1) and including at least one pawl (6, 7) provided on each of the front side (21) of the base plate (1) and an adjacent surface of the sanding pad (3) and having a contact surface (20) having a longitudinal extent a length (1) of which corresponds to from 0.2 to 1.3 times of a width of the front side (21) of the base plate, whereby attachment and detachment of the sanding pad (3) to and from the base plate (1) are effected by respective relative movements of the contact surfaces (20) of the respective pawls (6, 7) in opposite directions, the sander further comprising an adjusting lever (13) for displacing at least one of the pawls (7) between an engaging position, in which the contact surfaces (20) of the respective pawls (6, 7) engage each other and the sanding pad (3) is attached to the base plate (1), and a disengaging position in which the contact surfaces (20) of the respective pawls (6, 7) are disengaged from each other and the sanding pad (3) is detached from the base plate (1).

4. A sander according to claim 3, further comprising a locking plate mountable on one of the front sides (21) of the base plate (1) and the sanding pad (3), and wherein the at least one of the pawls (7) is arranged on the locking plate (8), and the locking pate (8) has an elongate opening (15) in which a bolt (14) associated with the adjusting lever (13) engages.

5. A sander according to claims 4, wherein the at least one of the pawls (7) is formed of metal.

6. A sander according to claim 4, wherein the locking plate (8) and the at least one bolt (7) are formed of sheet metal.

* * * * *